US010519691B2

(12) United States Patent
Billings

(10) Patent No.: US 10,519,691 B2
(45) Date of Patent: Dec. 31, 2019

(54) FENCE POST FOR A FLEXIBLE FENCE

(71) Applicant: Andrew W Billings, Fountain Valley, CA (US)

(72) Inventor: Andrew W Billings, Fountain Valley, CA (US)

( * ) Notice: Subject to any disclaimer, the term of this patent is extended or adjusted under 35 U.S.C. 154(b) by 203 days.

(21) Appl. No.: 15/628,061

(22) Filed: Jun. 20, 2017

(65) Prior Publication Data

US 2017/0370120 A1 Dec. 28, 2017

Related U.S. Application Data

(60) Provisional application No. 62/353,527, filed on Jun. 22, 2016.

(51) Int. Cl.

| | |
|---|---|
| ***E04H 17/16*** | (2006.01) |
| ***E04H 17/20*** | (2006.01) |
| ***E01F 9/669*** | (2016.01) |
| ***E04H 17/24*** | (2006.01) |
| ***E01F 13/02*** | (2006.01) |

(52) U.S. Cl.

CPC ..... *E04H 17/168* (2013.01); *E01F 9/669* (2016.02); *E01F 13/022* (2013.01); *E01F 13/028* (2013.01); *E04H 17/20* (2013.01); *E04H 17/24* (2013.01)

(58) Field of Classification Search

CPC ..... E04H 17/12; E04H 17/24; E04H 17/168; E04H 17/10; E04H 17/161; E04H 17/20; E01F 13/028; E01F 9/669; E01F 13/022

USPC ..... 256/24, 32

See application file for complete search history.

(56) References Cited

U.S. PATENT DOCUMENTS

| | | | | | |
|---|---|---|---|---|---|
| 305,571 | A | * | 9/1884 | Cheney | E04H 17/063 256/32 |
| 417,397 | A | * | 12/1889 | Salsich | E04H 17/063 256/32 |
| 851,445 | A | * | 4/1907 | Seymour | E04H 17/08 256/48 |
| 892,420 | A | * | 7/1908 | Harmon | E04H 17/12 256/56 |
| 962,632 | A | * | 6/1910 | Frost | E04H 17/063 256/32 |
| 963,004 | A | * | 6/1910 | Hlcks | E04H 17/10 256/54 |

(Continued)

FOREIGN PATENT DOCUMENTS

| | | | | | |
|---|---|---|---|---|---|
| GB | 216785 | A | * | 6/1924 | E04H 17/10 |

*Primary Examiner* — Matthew R McMahon

(74) *Attorney, Agent, or Firm* — Morland C. Fischer

(57) ABSTRACT

A fence post to be coupled to a flexible (e.g., mesh) fence to hold the fence above the ground. The fence post has a shaft to be driven into the ground. A downturned lower fence engaging hook extends from the bottom of the shaft to engage the bottom of the fence. The lower fence engaging hook is embedded in the ground along with the shaft of the fence post in order to hold the bottom of the fence against the ground. The fence post also has an upturned upper fence engaging hook extending from the top of the shaft to engage the top of the fence and hold the top of the fence up and above the ground. An upturned intermediate fence engaging hook extends from the shaft of the fence post between the lower and upper fence engaging hooks to engage the middle of the fence and hold the middle up.

4 Claims, 5 Drawing Sheets

(56) References Cited

U.S. PATENT DOCUMENTS

| | | | | |
|---|---|---|---|---|
| 1,632,231 | A * | 6/1927 | Holtz | E04H 17/10 256/23 |
| 1,714,388 | A | 5/1929 | McBride | |
| 2,053,195 | A | 9/1936 | Jernegan | |
| 4,860,996 | A * | 8/1989 | Robbins, III | A01K 3/00 256/10 |
| 6,149,135 | A | 11/2000 | Hlavin | |
| 6,543,750 | B1 | 4/2003 | Calzone | |
| 6,695,293 | B1 | 2/2004 | Kamarad et al. | |
| 7,909,310 | B2 | 3/2011 | Weiner | |
| 7,968,797 | B2 * | 6/2011 | Williams | H01B 17/22 174/154 |
| 8,308,141 | B1 * | 11/2012 | Mellins | A01K 3/00 256/11 |
| 2006/0175589 | A1 | 8/2006 | Cooksley | |
| 2009/0152522 | A1 * | 6/2009 | Underwood | E04H 17/161 256/24 |
| 2013/0328002 | A1 | 12/2013 | Hendricks | |
| 2014/0326938 | A1 | 11/2014 | Poschelk et al. | |

* cited by examiner

FENCE POST FOR A FLEXIBLE FENCE

CROSS REFERENCE TO RELATED APPLICATIONS

This application is related to Provisional Patent Application No. 62/353,527 filed Jun. 22, 2016.

BACKGROUND OF THE INVENTION

1. Field of the Invention

This invention relates to a fence post to which any one of a mesh fence, a strip of barrier caution tape and/or a fence support wire are coupled by which to create a barrier at a (e.g., construction) site to which access by the public is to be restricted. The fence post include a shaft from which lower, upper and intermediate fence engaging coupling hooks extend to engage lower, upper and middle portions of the fence to reliably hold the fence up and in place.

2. Background Art

Flexible mesh fences are widely used at construction sites and other potentially hazardous locations to create a barrier by which to restrict public access. The flexible fences are commonly held in place above the ground at the protected site by a series of construction posts. A flexible fence is often connected to each post by means of one or more plastic ties. However, it may sometimes be difficult and time consuming to use the ties to connect a long fence to a large number of construction posts. In this same regard, it may require the services of more than a single workman to construct a barrier around a large site. In the case where the ties are tightened around the construction posts to hold the fence in place, the ties are known to be unreliable and slide down the posts over time, whereby the fence can fall to the ground to allow the barrier to be breached. Moreover, the conventional construction post is installed by means of using a tool such as a hammer to apply an impact force to the top of the post by which the post is driven into the ground. Applying a driving impact force to the top of the post s known to lead to injury in cases where a hand of the workman holding the top of the post is accidentally struck by the tool.

Accordingly, an improved fence post would be desirable which avoids the aforementioned shortcomings associated with the conventional construction post.

SUMMARY OF THE INVENTION

In general terms, an improved fence post is disclosed to be installed in the ground and to which a flexible mesh fence or the like is coupled to create a barrier by which to restrict public access to a construction site or another potentially hazardous location. The improved fence post includes an elongated shaft having a curved downwardly bending end cap affixed to the top thereof at which to receive an impact force for driving the bottom of the shaft into the ground. A first fence engaging coupler (e.g., a hook) extends from the bottom of the shaft and turns downwardly towards the ground. A second fence engaging coupler e.g., a hook) extends from the top of the shaft and turns upwardly away from the ground. A third fence engaging coupler (e.g., a hook) extends from the shaft between the lower and upper fence couplers and turns upwardly away from the ground.

The mesh fence is coupled to the fence post by first moving the first downturned fence engaging coupler through an opening formed in the bottom of the fence. The first downturned fence engaging coupler is embedded within the ground at the same time that the shaft of the fence post is driven into the ground whereby the bottom of the mesh fence is held against the ground. The second upturned fence engaging coupler is then moved through an opening formed in the top of the mesh fence whereby to engage and hold the top of the fence above the ground. Finally, the third upturned fence engaging coupler is moved through an opening formed in the middle of the mesh fence whereby to engage and hold the middle of the fence above the ground. By virtue of the first, second and third fence couplers that extend from the shaft of the fence post, the bottom, top and middle of the mesh fence are reliably held up and in place above the ground. The fence post may also include a barrier tape retaining enclosure affixed to the shaft thereof through which a section of barrier caution tape is received and/or a wire pass-through hole formed in the second upturned fence engaging coupler that extends from the top of the shaft through which a fence support wire is received.

DESCRIPTION OF THE PREFERRED EMBODIMENTS

Figure 1:
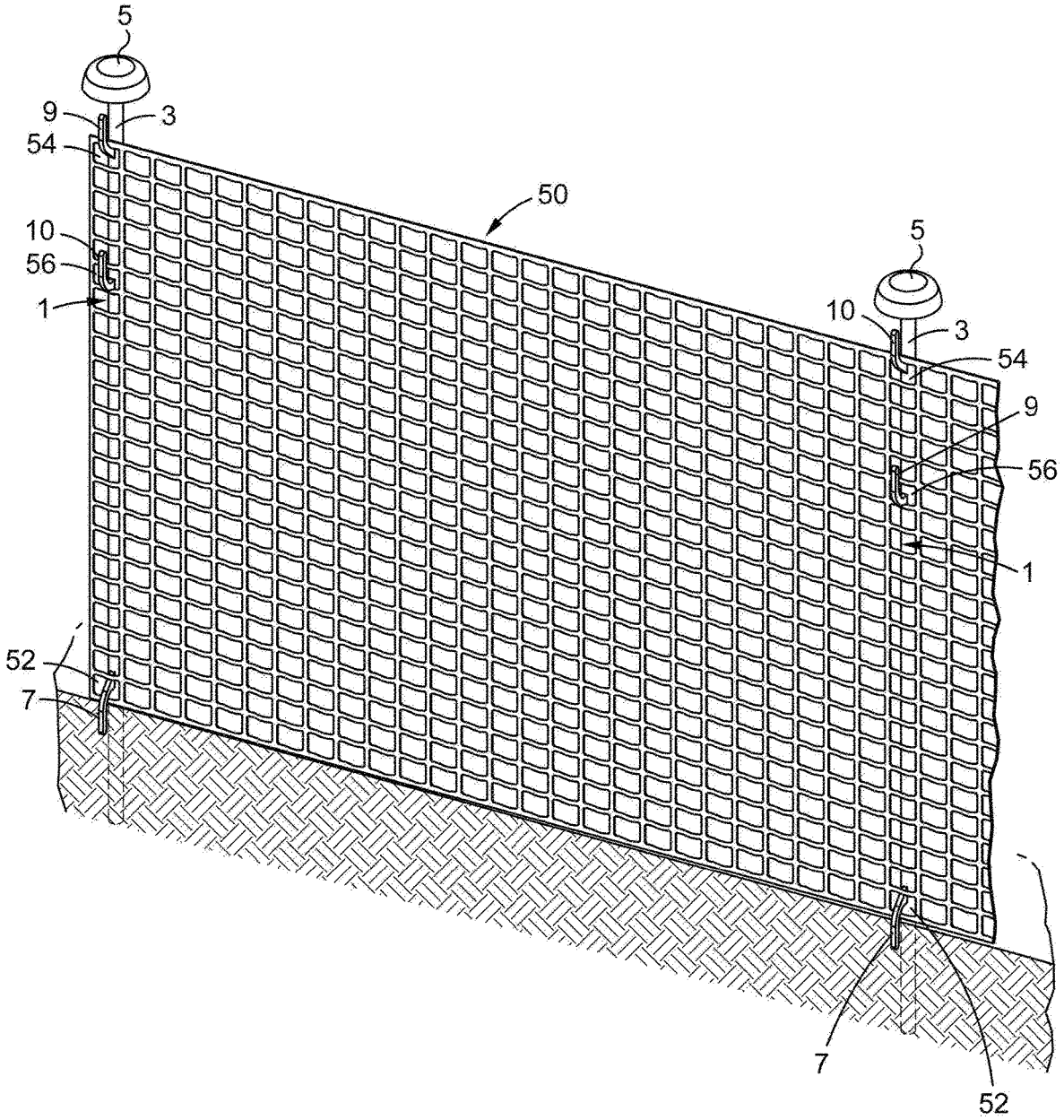
FIG. 1 shows a flexible mesh fence coupled to and held in place above the ground by a pair of fence posts according to a first preferred embodiment of this invention.

Referring initially to FIGS. 1-4 of the drawings, there is shown a fence post 1 according to a first preferred embodiment of this invention. As is best shown in FIG. 1, the fence post 1 has particular application to be used with a conventional flexible (e.g., mesh or silt) fence 50 of the kind that has a plurality of holes formed therein and is often used to assemble a barrier at a construction site or at any other potentially hazardous site where access to the site by the general public is to be restricted. A plurality of the fence posts 1 are spaced from one another and coupled to the flexible fence 50 in a manner to be described hereinafter. The fence posts 1 hold the fence 50 up and in place at the site until it is desirable to remove the posts and the fence to which the posts are coupled.

Figure 2:
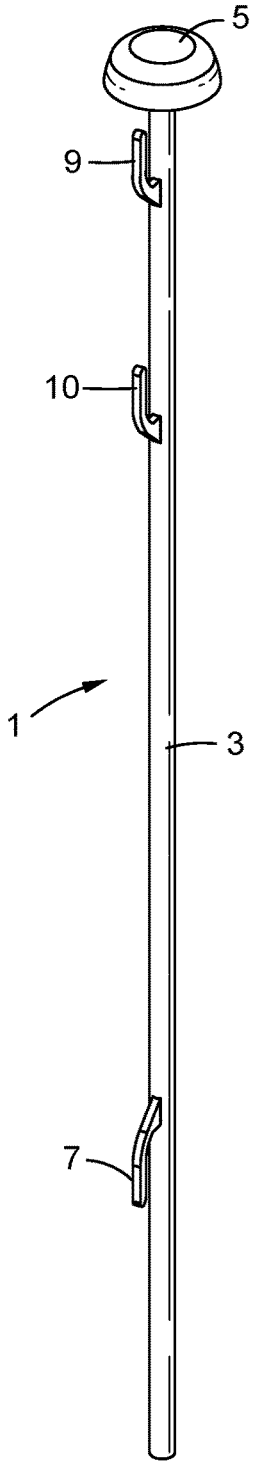
FIG. 2 is a perspective view of one of the fence posts shown in FIG. 1.
Figure 3:
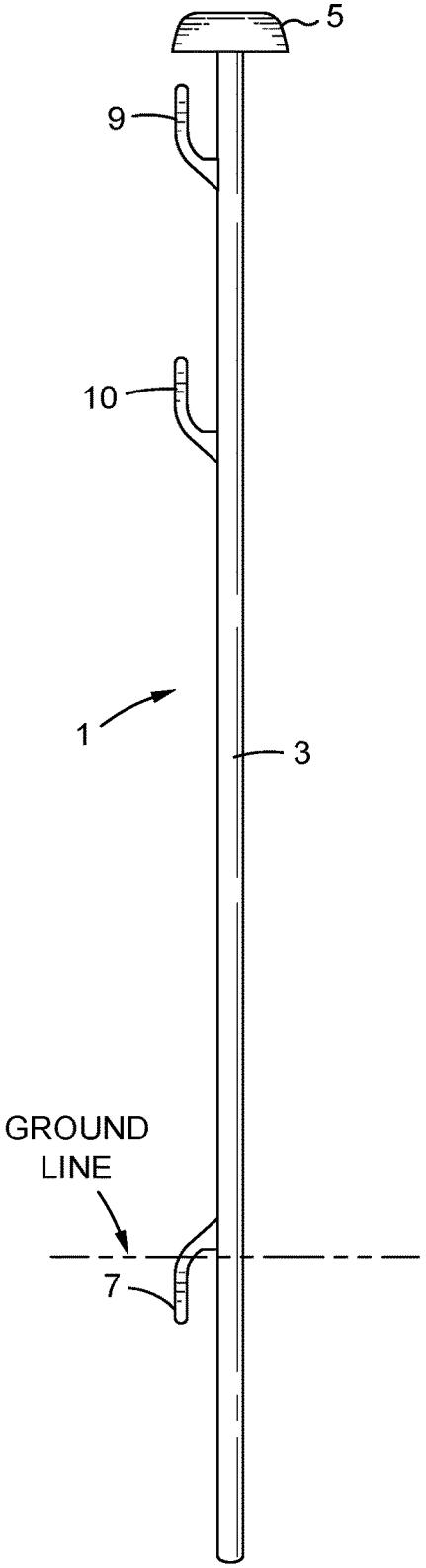
FIG. 3 is a side view of the fence post shown in FIG. 2.
Figure 4:
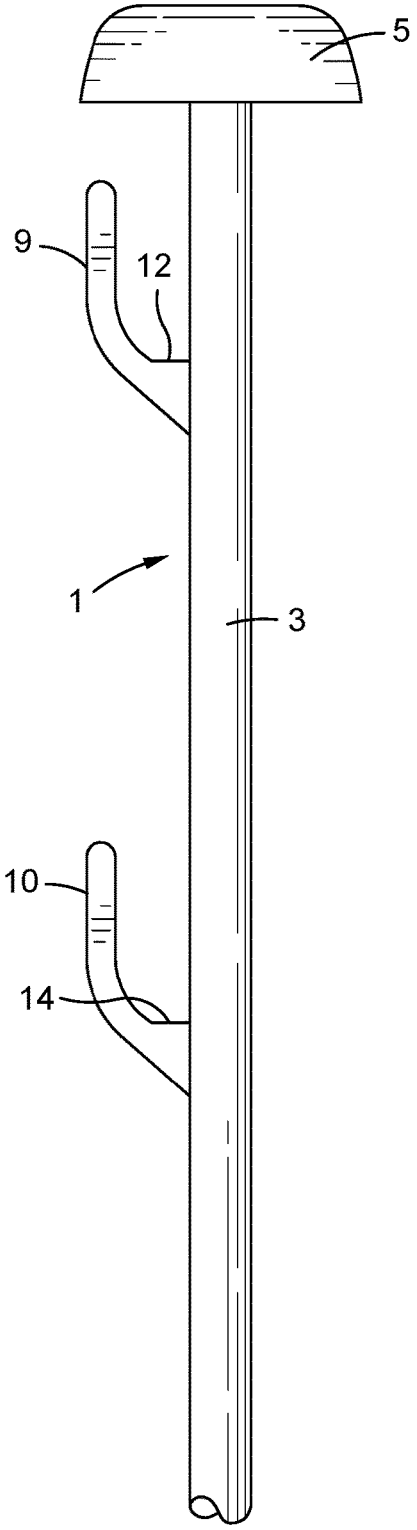
FIG. 4 is an enlarged view of the top of the fence post shown in FIG. 3.

As is best shown in FIGS. 2-4, the fence post 1 has an elongated shaft 3 that is preferably longer than the height of the flexible fence to which the post will be coupled. The fence post 1 is manufactured from a strong, durable and weather resistant material such as steel or the like. Located at the top of the shaft 3 of the fence post 1 is an end cap 5.

The end cap 5 is welded to the shaft 3 and sized so as to be capable of receiving an impact force applied thereto by means of a hammer, a mallet, or similar tool to drive the shaft 3 into the ground. As one advantage of the fence post 1 herein disclosed, the end cap 5 has a curved downwardly bending configuration atop the shaft 3 to more evenly distribute the impact forces delivered by the tool around the cap 5 to avoid the possibility that the cap 5 will break off the shaft 3. The curved end cap 5 also provides a safety hand guard below which the user's hand can grip the shaft 3 to avoid being struck by the tool during the installation of the fence post 1. Likewise, because it is curved, the end cap 5 has no sharp or pointed corners which could injure the hand.

Located near the bottom of the shaft 3 of fence post 1 opposite the curved end cap 5 is a downturned lower fence engaging coupler such as a hook 7. The hook 7 is welded to the bottom of the shaft 3 so as to extend outwardly from the shaft and bend downwardly towards the ground when the post 1 is installed in the ground. It is preferable that the bottom of the shaft 3 extend only a short distance below the hook 7 so as to avoid the possibility of striking an underground service (e.g., a cable run) above which the post 1 is installed. As is best shown in FIG. 1, the downturned lower fence engaging hook 7 is sized and positioned on the shaft 3 to be able to move through one of the plurality of holes 52 formed at the bottom of the fence 50 so as to loop over and engage a first portion of the fence which surrounds the hole 52. In this regard, the lower fence engaging hook 7 is moved through the hole 52 in the fence prior to the installation of the fence post 1 in the ground. Accordingly, when the fence post 1 is installed (by applying an impact force to the curved end cap 5), the shaft 3 is driven into the ground at the same time that the hook 7 is embedded in the ground. Therefore, the bottom of the fence will be captured and held in place against the ground by the downturned hook 7.

Located at the top of the shaft 3 of fence post 1 below the curved end cap 5 is an upturned upper fence engaging coupler such as a hook 9. The hook 9 is welded to the top of the shaft 3 so as to extend outwardly from the shaft so as to bend upwardly therefrom and turn away from the ground when the post 1 is installed in the ground. As is also best shown in FIG. 1, the upturned upper fence engaging hook 7 is sized and positioned on the shaft 3 to be able to move through one of the holes 54 at the top of the fence 50 so as to loop under and engage a second portion of the fence which surrounds the opening 54. In this case, the fence 50 is ideally coupled to the hook 9 of the fence post 1 after the post has first been installed in the ground. Accordingly, the top of the fence will be held up and in place above the ground by the upturned upper fence engaging hook 9.

Located at approximately the id-point of the shaft 3 of fence post 1 between the lower fence engaging hook 7 and the upper fence engaging hook 9 is an upturned intermediate fence engaging coupler such as hook 10. The intermediate fence engaging hook 10 is welded to the shaft 3 so as to extend outwardly from the shaft to bend upwardly therefrom and turn away from the ground once the post 1 is installed in the ground. As is also shown in FIG. 1, the upturned intermediate fence engaging hook 10 is sized and positioned on the shaft 3 to be able to move through one of the holes 56 located between the top and the bottom of the fence 50 so as to loop under and engage a third portion of the fence near the middle thereof that surrounds the opening 56. Accordingly, after the fence post 1 has been installed and the fence 50 is coupled thereto as previously described, the middle of the fence will be held up and in place above the ground by the upturned intermediate fence engaging hook 10.

By virtue of the lower, upper and intermediate fence engaging couplers (i.e., hooks) 7, 9 and 10 that extend from the shaft 3 of the fence post 1, a continuous vertical support of the fence 50 is provided along the bottom, top and middle thereof by which to reliably hold the fence in place above the ground at the site to be protected. The upwardly bending upper and intermediate fence engaging hooks 9 and 10 are of sufficient length to create deep vertical pockets 12 and 14 adjacent the shaft 3 so as to make it easy for the fence to slide downwardly along the hooks 9 and 10 but also make it difficult for the fence 50 to slide off the hooks 9 and 10 and become inadvertently detached from the post 1. Thus, the fence 50 will be less likely to separate from the fence post 1 under its own weight or when subjected to wind. When it is desirable to remove the fence 50 from the post 1, the post s first pulled out of the ground and the fence engaging hooks 7, 9 and 10 are then withdrawn from the bottom, top and middle holes 52, 54 and 56 that are formed in the fence.

Figure 5:
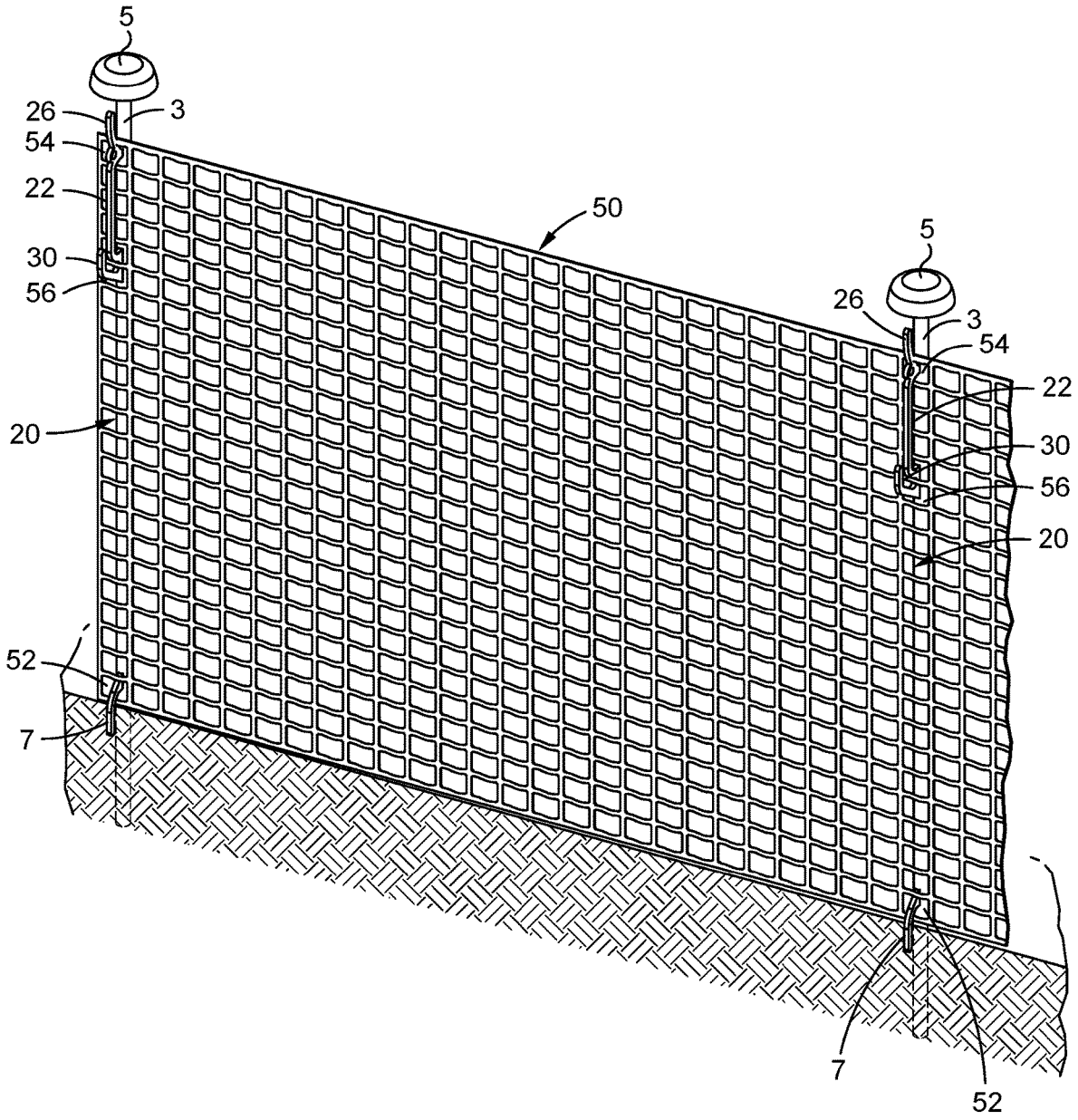
FIG. 5 shows a flexible mesh fence coupled to and held in place above the ground by a pair of fence posts according to another preferred embodiment of this invention.

Turning now to FIGS. 5-8 of the drawings, there is shown a fence post 20 according to another preferred embodiment of this invention. As in the case of the fence post 1 of FIGS. 1-4, the fence post 20 has particular application to be used with a flexible mesh or silt fence like that designated 50 and shown in FIG. 1. Therefore, identical reference numbers will be used to describe the same fence 50 that is shown in FIGS. 1 and 5. What is more, the fence post 20 of FIGS. 5-8 has features (i.e., an elongated shaft 3, a curved end cap 5 at the top of the shaft 3, and a downturned lower fence engaging hook 7 at the bottom of the shaft 3) which are identical to those features associated with the fence post 1 shown in FIGS. 1-4. Therefore, identical reference numbers will be used to describe the common features of both fence posts 1 and 20, and these same features and the advantage thereof will not be described again.

The fence post 20 shown in FIGS. 5-8 has the additional feature of a barrier caution tape retaining enclosure 22. The barrier caution tape retaining enclosure 22 is welded to the shaft 3 of fence post 20 so as to be spaced therefrom and surround a channel 24 (best shown in FIG. 8) through which to receive a strip of flexible barrier caution tape. As is best shown in FIG. 9 of the drawings, the barrier caution tape 60 is fed through the channel 24 that is surrounded by the barrier caution tape enclosure 22. The barrier caution tape 60 is of the well-known kind that can be brightly colored and/or contain a printed message to provide a warning to passersby concerning the site at which the fence post 20 has been installed. The barrier caution tape 60 is shown in FIG. 9 being received by and passing through the channel 24 of each of a pair of the fence posts 20 that are spaced from one another at the site to be protected.

Figure 6:
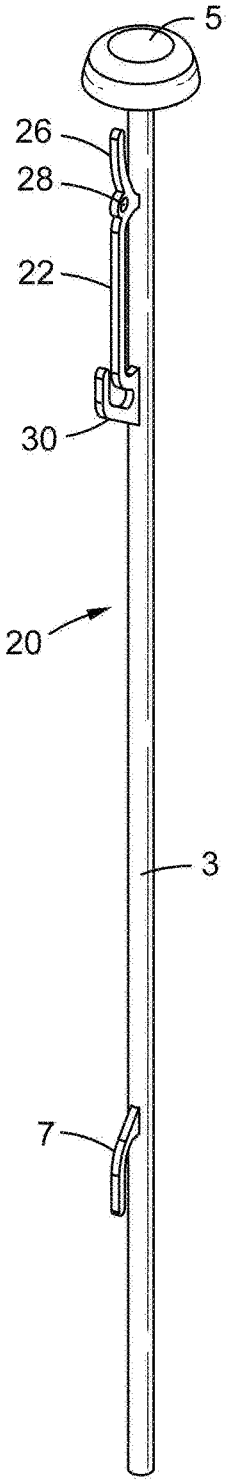
FIG. 6 is a perspective view of one of the fence posts shown in FIG. 5.
Figure 7:
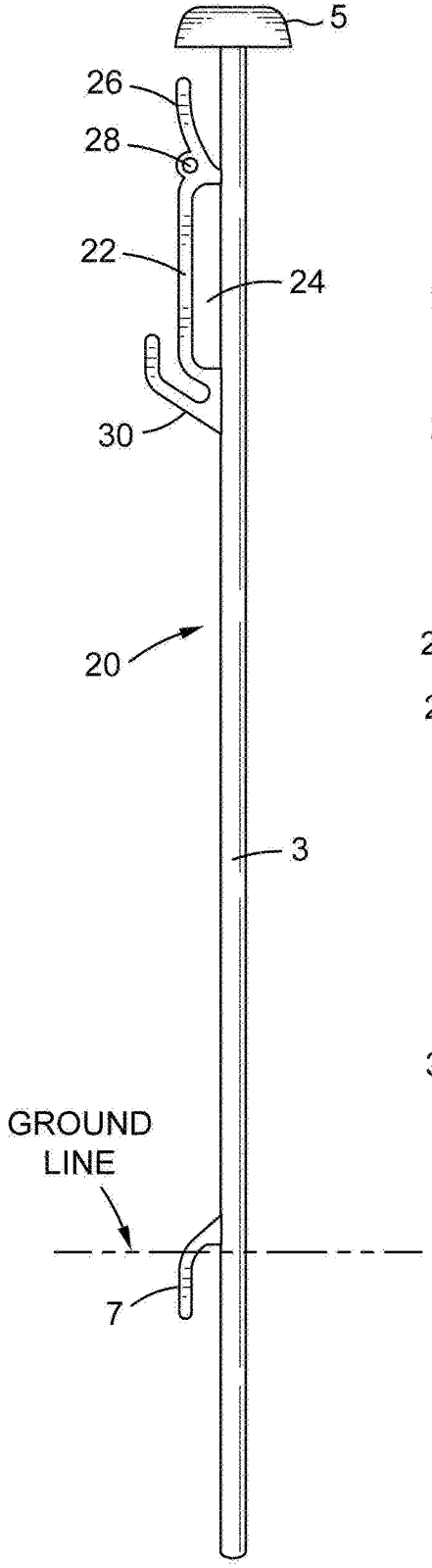
FIG. 7 is a side view of the fence post shown in FIG. 6.
Figure 8:
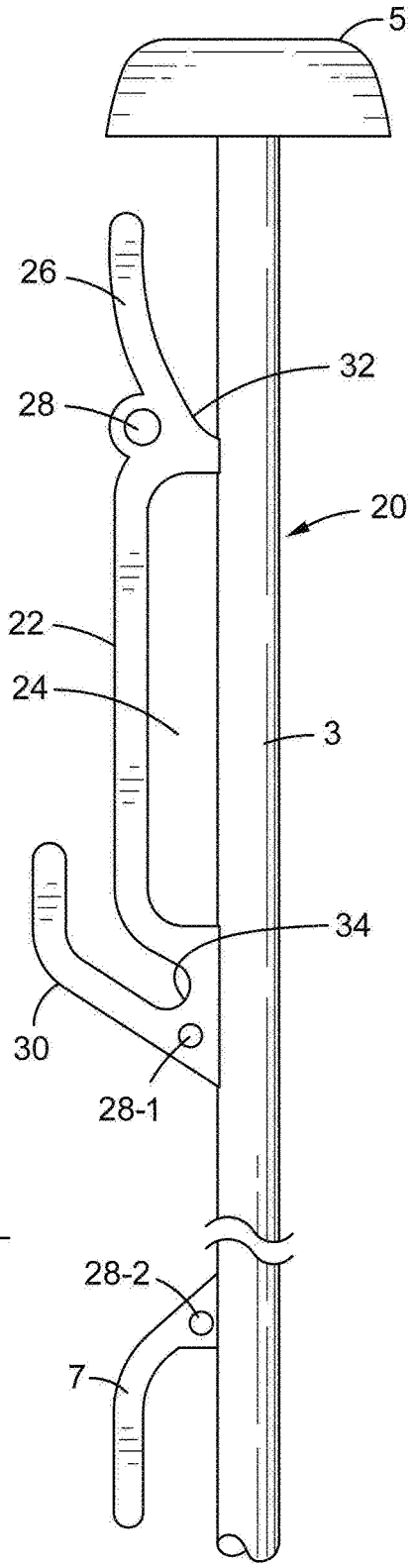
FIG. 8 is an enlarged view of the top of the fence post shown in FIG. 7.
Figure 9:
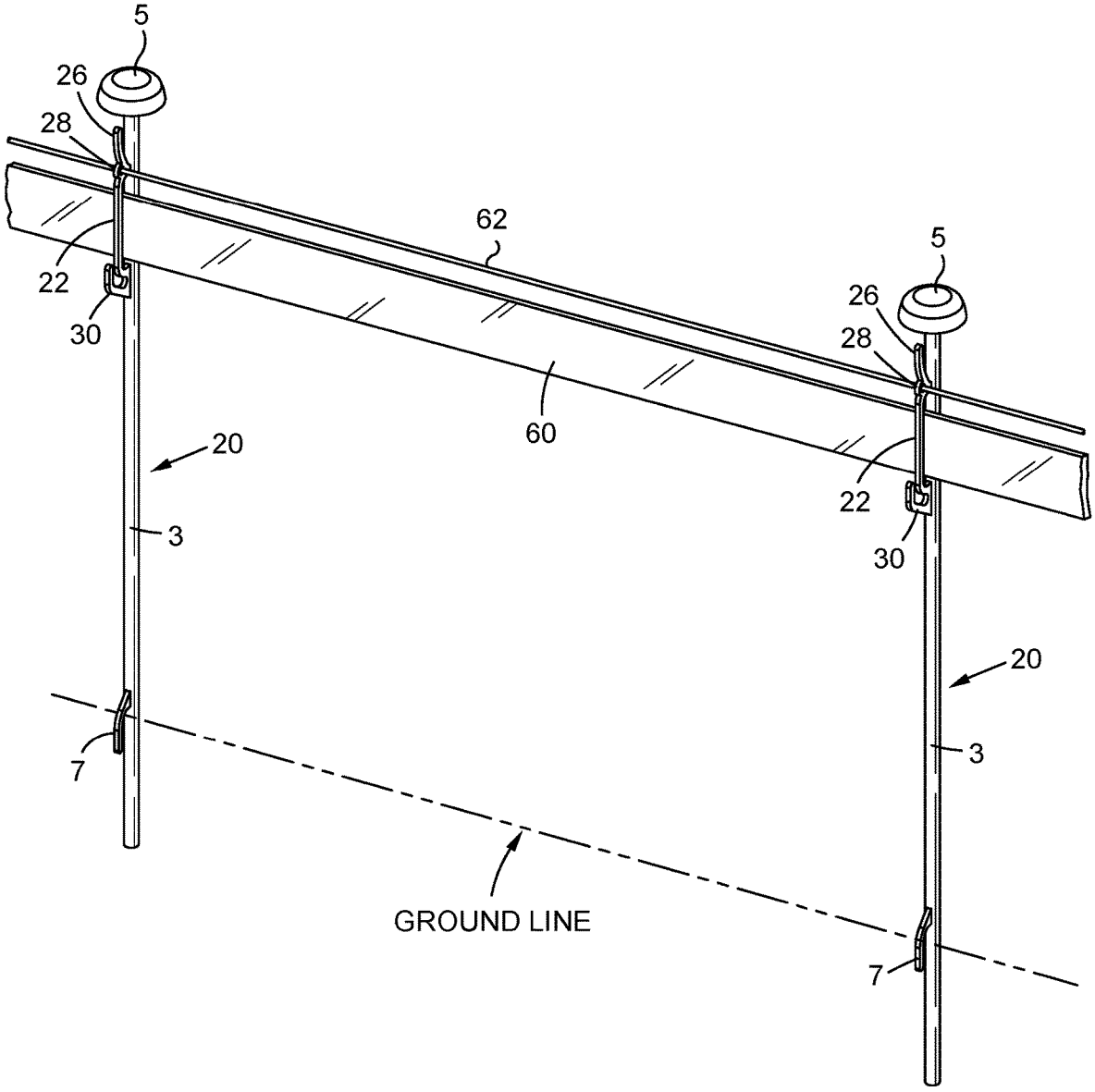
FIG. 9 shows a section of barrier caution tape and a wire coupled to and extending between the pair of fence posts shown in FIG. 5 by which to be held in place above the ground.

In this regard, it is to be understood that the fence post 20 of FIGS. 6-8 can be used to receive and hold the strip of barrier caution tape 60 above the ground independently of the flexible mesh fence 50. That is to say, a fence need not be coupled to the fence post 20, and the barrier caution tape 20 can be used instead to surround and prevent access to a protected site in place of the fence.

Located at the top of the shaft 3 of the fence post 20 below the curved end cap 5 is an upturned upper fence engaging coupler such as a hook 26. The upper fence engaging hook 26 and an upper first end of the aforementioned barrier tape retaining enclosure 26 are coextensively joined to one another, and the intersection therebetween is welded to the shaft 3. Thus, like the upper fence engaging hook 7 of the fence post 1, the upturned upper fence engaging hook 26 extends outwardly from the shaft 3 of fence post 20 so as to bend upwardly therefrom and turn away from the ground when the post 20 is installed.

As is best shown in FIG. 9, the upturned upper fence engaging hook 26 of the fence post 20 is sized and positioned on the shaft 3 to be able to move through one of the holes 54 formed in the top of the fence 50 so as to loop under and engage a portion of the fence 50 which surrounds the hole 54. The top of the fence 50 is ideally coupled to the fence post 20 after the shaft 3 thereof and the lower fence engaging hook 7 extending from the bottom of the shaft have first been installed so that the top of the fence will be held up and in place above the ground by the upturned fence engaging hook 26.

A wire pass-through hole 28 is formed in the upper fence engaging hook 26 of the fence post 20 at the intersection of the hook 26 and the upper end of the barrier tape retaining enclosure 22. As is best shown in FIG. 9, a fence post support ire 62 is fed through the wire pass-through hole 28 of each of a pair of the fence posts 20 that are installed in the ground and spaced from one another. The wire 62 being strung between a series of posts 20 located at the site as shown in FIG. 9 helps to stabilize the posts and retains their upright position above the ground at those times when the posts are exposed to high wind or other turbulent conditions. In the alternative, the wire 62 may be an electrical wire of the kind along which information is transmitted.

Located at approximately the mid-point of the fence post 20 between the upturned upper fence engaging hook 26 and the downturned lower fence engaging hook 7 is an upturned intermediate fence engaging coupler such as a hook 30. The intermediate fence engaging hook 30 and a lower opposite end of the barrier tape retaining enclosure 22 are coextensively joined to one another, and the intersection therebetween is welded to the shaft 3. Thus, like the intermediate fence engaging post 10 of the fence post 1, the upturned intermediate fence engaging hook 30 extends outwardly from the shaft 3 of fence post 20 so as to bend upwardly therefrom and turn away from the ground when the post 20 is installed in the ground.

As is best shown in FIG. 5, the upturned intermediate fence engaging hook 30 of the fence post 20 is sized and positioned on the shaft 3 to be able to move through one of the holes 56 formed between the top and the bottom of the fence 50 so as to be able to loop under and engage a middle portion of the fence which surrounds the hole 56. The middle portion of the fence 50 is ideally coupled to the fence post 20 at the upturned intermediate fence engaging hook 30 after the post has first been installed in the ground.

As an option, a wire pass-through hole 28-1 and 28-2 can be formed in either one or both of the upturned intermediate fence engaging hook 30 and/or the downturned lower fence engaging hook 7 of fence post 20 (best shown in FIG. 8). Thus, fence post support wires like that designated 62 in FIG. 9 can be fed through respective wire pass-through holes 28, 28-1 and 28-2 to help stabilize a series of fence posts. In this same regard, a single fence post support wire can be strung through the pass-through hole at the top of one fence post and the pass-through hole at the middle or bottom of an adjacent fence post (not shown).

By virtue of the lower, upper and intermediate fence engaging couplers (i.e., hooks) 7, 26 and 30 that extend from the shaft 3 of the fence post 20, a continuous vertical support of the fence 50 is provided along the bottom, top and middle thereof by which to reliably hold the fence in place above the ground at the site to be protected. The upwardly bending upper and intermediate fence engaging hooks 26 and 30 are of sufficient length to create downwardly sloping vertical pockets 32 and 34 adjacent the shaft 3 so as to make it easy for the fence to slide downwardly along the hooks 26 and 30 but also to make it difficult for the fence 50 to slide off the hooks 26 and 30 and become inadvertently detached from the post 20. Thus, the fence 50 will be less likely to separate from the fence post 20 under its own weight or when subjected to wind. When it is desirable to remove the fence 50 from the post 20, the post is first pulled out of the ground and the fence engaging hooks 7, 26 and 30 are then withdrawn from the bottom, top and middle holes 52, 54 and 56 that are formed in the fence.

The invention claimed is:

1. A combination comprising:

a fence having a top and a bottom, said fence being manufactured from mesh and having a plurality of holes formed therein; and a fence post to be coupled to the mesh fence by which to hold the mesh fence in place, said fence post including:

a cylindrical shaft having a top and a bottom;

a first fence engaging hook extending outwardly from the bottom of the cylindrical shaft of said fence post and facing downwardly, said first fence engaging hook engaging the bottom of the mesh fence at a first of said plurality of holes formed therein in order to hold down the bottom of said mesh fence;

a second fence engaging hook extending outwardly from the top of the cylindrical shaft of said fence post and facing upwardly, said second fence engaging hook engaging the top of the mesh fence at a second of said plurality of holes formed therein in order to hold up the top of said mesh fence;

a third fence engaging hook extending outwardly from the cylindrical shaft of said fence post between said first and second fence engaging hooks and facing upwardly and in the same direction as said second fence engaging hook, said third fence engaging hook engaging a third portion of the mesh fence at a third of said plurality of holes formed therein lying between the top and bottom of the mesh fence in order to hold up the third portion of said mesh fence;

a barrier caution tape enclosure being affixed to one side of the cylindrical shaft of said fence post and surrounding a barrier tape opening that is sized to receive a strip of barrier tape therethrough, said barrier caution tape enclosure extending continuously from said second fence engaging hook to said third fence engaging hook; and a wire receiving hole formed in at least one of said first, second and third fence engaging hooks and sized to receive a section of wire passing therethrough.

2. The combination recited in claim 1, wherein there is a wire receiving hole formed in each of said first, second and third fence engaging hooks and sized to receive respective sections of wire passing therethrough.

3. The combination recited in claim 1, further comprising an end cap affixed to and extending outwardly from the top of said cylindrical shaft to receive an impact force thereagainst.

4. The combination recited in claim 1, wherein said first, second and third fence engaging hooks are aligned with one another so as to lie in a straight line one above the other.

* * * * *